United States Patent [19]

Soder et al.

[11] Patent Number: 5,065,374

[45] Date of Patent: Nov. 12, 1991

[54] LEATHER WATCHCASE AND METHOD OF MANUFACTURE THEREOF

[75] Inventors: Robert Soder, Montreux; Albert Willemin, Le Landeron, both of Switzerland

[73] Assignee: ETA SA Fabriques d'Ebauches, Granges, Switzerland

[21] Appl. No.: 112,155

[22] Filed: Oct. 26, 1987

[30] Foreign Application Priority Data

Oct. 28, 1986 [CH] Switzerland ..... 04263/86

[51] Int. Cl.[5] ..... G04B 37/00

[52] U.S. Cl. ..... 368/280; 368/282; 368/295

[58] Field of Search ..... 368/280–282, 368/62, 88, 276, 283–310

[56] References Cited

U.S. PATENT DOCUMENTS

| | | | |
|---|---|---|---|
| 4,084,415 | 4/1978 | Corman | 368/221 |
| 4,575,833 | 3/1986 | Bakhtiari | 368/88 |
| 4,731,766 | 3/1988 | Bunyea | 368/10 |

*Primary Examiner*—Bernard Roskoski

*Attorney, Agent, or Firm*—Griffin Branigan & Butler

[57] ABSTRACT

The watch case of this invention includes a casebandbezel formed of solid leather. According to one method of manufacture one begins with a blank of leather having dimensions slightly greater than those of the finished article such blank being subjected to the following operations in succession: drying, impregnation, hardening, machining to final tolerances and finishing.

Natural or reconstituted leather may be employed.

14 Claims, 2 Drawing Sheets

LEATHER WATCHCASE AND METHOD OF MANUFACTURE THEREOF

This invention concerns a watch case.

BACKGROUND OF THE INVENTION

On various occasions it has been proposed to cover a watch case with leather The Swiss patent 129.046 describes a watch case including at least one non-metallic decorative inlay offering the aspect of a natural or imitation reptile skin from leather which is finished so as to give it the aspect and the design of a true reptile skin. The cited document suggests the application of such a covering by any suitable procedure on any desired portion of the watch case, for instance by gluing or setting either on the outer surface of the back cover or the case band, or on the bezel.

In order to avoid contacting the back cover of a steel watch case with the skin, it has likewise been suggested in Swiss patent 354.390 to cover such back cover with a layer of leather to prevent skin infections brought about by such contact.

For decorative reasons the German utility model 1.973.982 envisages covering the dial of a clock with leather, hide or tissue.

All these documents make reference to leather coverings of very small thickness. It will be however understood that applied to a watch, such a covering will be of a duration rather limited by wear, above all due to rubbing of clothing against the case. In the same manner, the mechanical retention of the covering generally assured by gluing often leaves much to be desired. Portions of such covering may be detached from the substrate onto which they are glued, thus allowing appearance of conspicuous and very inelegant blemishes.

SUMMARY OF THE INVENTION

The present invention overcomes these difficulties by proposing a watch case in which at least one of its basic parts is formed of solid leather and as well procedures for the manufacture of such basic parts.

The invention will be understood following reading of the description to follow of several embodiments of such invention given by way of example and illustrated by the accompanying drawings.

DESCRIPTION OF THE PREFERRED EMBODIMENTS

The object of the invention being concerned with a watch case of which at least one of the basic portions is of solid leather, it will be helpful to define here what is understood by the word "leather". By definition, one understands by leather all animal skins separated from the flesh, tanned and prepared. It is thus that to satisfy such invention one may employ leather from oxen, from buffaloes, cows, calves (box-calf, vellum), goats (morocco), sheep (tan, shagreen) or from reptiles (crocodile, lizard).

The leather to be utilized may also appear under two forms: natural or reconstituted leather.

By natural leather is understood that which is removed from the animal, tanned, prepared and employed in its natural state. In certain case the thickness of such leather will be sufficient to manufacture from a single layer the basic part of the watch case which it is proposed to form. It is thus that a single layer of buffalo hide for instance could form in some circumstances a caseband-bezel for a watch. In other cases however it will be necessary to stack at least two layers of leather to arrive at the desired thickness. This could be the case for leather from small animals for instance. Such stacking may be obtained by gluing two or several thicknesses of leather.

By reconstituted leather it is understood that one will use powders, grains, filaments or scraps of leather which will be compressed with a binder. One may thus obtain a matter the texture of which recalls that of natural leather.

Reference will now be had to the drawings the figures of which exhibit several embodiments of a watch case of which at least one basic part is of solid leather.

Figure 1:
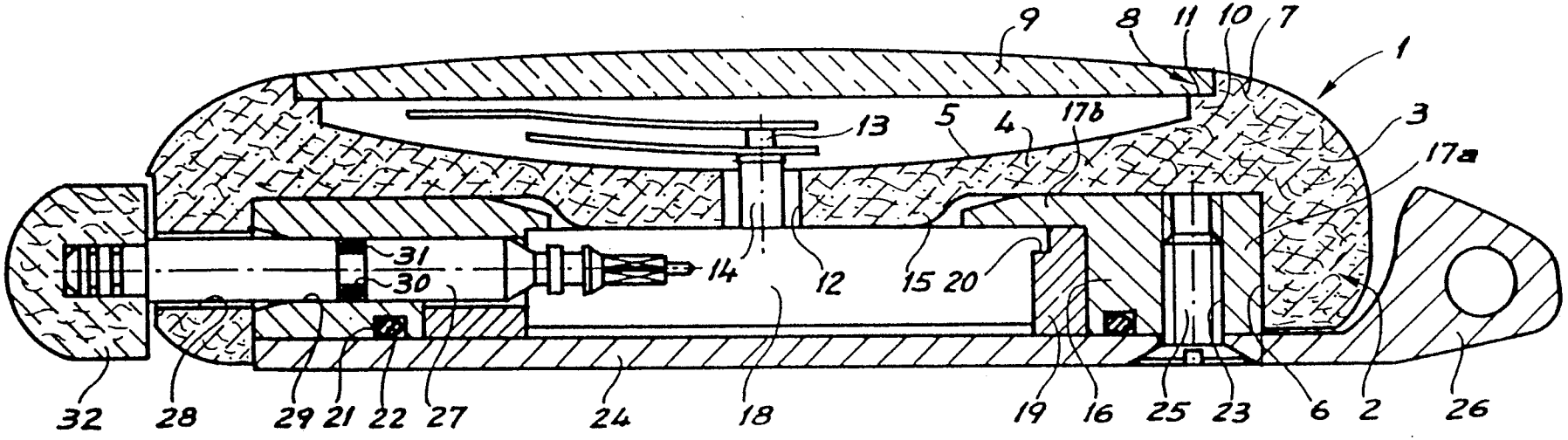
FIG. 1 shows a broken diametral cross-section of the watch case according to the invention and according to a first embodiment, such case being formed from a caseband-bezel and dial fashioned in one single piece from leather.

FIG. 1 is a cross-section through a watch the case of which comprises a caseband-bezel and a dial formed from a single piece of solid leather according to a first embodiment of the invention wherein the case 1 includes a part 2 formed of solid natural or reconstituted leather. This part which is in one single piece includes a ring forming an outer caseband 3 of the case and a bezel 7 integrally formed with the caseband. A shell 4 likewise integrally formed with the caseband-bezel fills in the ring and the upper surface 5 of shell 4 serves as a dial.

The portion 2 bounds a circular central housing 6 which here is co-axial with the outer form of the case band 3. This latter exhibits a semi-toroidal periphery. However, it is to be noted that the placing of caseband 3 and housing 6 are not imperative and are determined only by the appearance which one wishes to give to the timepiece, the housing 6 thus being possibly located off center relative to the general form of the caseband 3 of leather which itself may exhibit greatly varied exterior forms.

The face of the shell 4 forming dial 5 is concave and is bounded by bezel 7. Such bezel 7 defines by its form means 8 for positioning and securing a crystal 9. In the embodiment shown this means comprises an annular step 10 bounding a shoulder 11 on which may be applied the crystal 9 by means of a glue joint. The crystal 9 is thus sunken in the thickness of the bezel 7.

The shell 4 is pierced at its center by a hole 12 for enabling passage of the shafts 13 and 14 for the hands. Furthermore, its central zone includes a stiffening portion 15 in order to obtain rigidity of the shell at this place.

An interior metallic caseband 16 is arranged in the housing 6. This caseband includes an annular ring 17*a* from whence extends towards the interior flange 17*b* and is glued to the outer caseband 3 by glue joints interposed between the respective outer and inner peripheral walls of the casebands and likewise (although not indispensable) between the upper face of the interior caseband 16 and the corresponding portion of the lower surface of shell 4.

The inner caseband 16 is primarily intended to receive movement 18 of the timepiece with the aid of a casing ring 19. In the example shown the movement 18 is assumed to be of the barrel type, the casing ring 19 thus not exhibiting a constant radial section over its entire periphery as may be seen to the left and to the right on the figure. The casing ring includes a shoulder 20 cooperating with a collar provided in a known manner on the periphery of the movement.

An annular groove 21 is provided in the lower face of the inner caseband in order to receive a seal 22. Furthermore, several threaded holes 23 are provided in this caseband in order to permit its assembly with a back cover 24 by means of screws 25. The back cover is formed by a circular plate the form of which is adapted to the form of the assembly and which is adjusted practically entirely within the opening of housing 6. This plate bears lugs 26 at noon and at 6 o'clock intended to fasten a bracelet which is not shown on the drawing.

It may thus be determined that the timepiece for its water tightness requires only one seal at the level of the back cover acting effectively through contact with the metal, the seal being furthermore retained on all portions by the rectangular section bounded by the back cover and the groove 21.

A time setting stem 27 traverses a radial hole 28 pierced in the outer caseband 3 as well as a radial hole 29 provided in the inner caseband 16. Stem 27 is provided with a groove 30 intended to receive a packing 31. A crown 32 enables manipulating stem 27. The crown 32 may be formed of leather just as part 2.

In order to manufacture the annular part 2 including the outer caseband 3, the bezel 7 and the shell 4, all formed from a single piece of solid leather, one may follow one or the other of the following procedures.

A first procedure consists in taking a blank of natural leather of which the diametral and thickness dimensions are slightly greater than the dimensions of the object which one wishes to obtain. The blank is dried in order to remove such water as it may contain. The porous structure thereof is impregnated with an organic material which is allowed to harden. At this stage the hardness of the blank is greatly superior to that of the raw leather and this enables machining the blank to the dimensions required by the design of the case which one wishes to obtain and this by means of ordinary cutting tools (turning, grinding, etc.). Finally, the part may be terminated by a finishing operation.

The finishing operation consists in giving to the machined part an elegant aspect. This could be obtained by sand blasting which could give it the aspect of suede. This could also be obtained by a superficial impregnation with or without additional colouring. It could likewise be by decoration in the form of a coating, for instance the gluing of a selected fine skin on the dial.

Should the blank be too thin to manufacture the part over its entire thickness, there will be employed a second blank which will be glued to the first after having effected the impregnation operation on each of the blanks. It is also possible to glue together the blanks during the impregnation operation, the impregnation material serving at the same time as a gluing material between blanks.

The impregnation material may be a resin which can be hardened either hot or cold. Such material could likewise contain a colouring matter which would enable tinting the leather in its bulk and by a colour other than that which is natural to it.

The second procedure consists of beginning with the same blank as that which has been mentioned hereinabove. Following drying the blank is impregnated and pressed and formed in a mould in order to give it the final form. It is allowed to be hardened within the mould which will thereby confer a solid structure to it. Following removal from the mould, it may be subjected to a finishing operation. It will be noted that the second procedure could also be practised with a blank comprising several thicknesses of leather either pre-glued or glued together during hardening of the impregnation material.

Here the finishing operations may be those which have been mentioned hereinabove. Furthermore, one may benefit from the utilization of the mould in order to give the outer surface of the piece a special aspect, for instance matt or brilliant or a particular hide structure (box-calf, crocodile, snake skin, etc.). A positive or negative relief may also be bestowed on the surface of the piece as for instance the impression of the hours indicia on the dial.

Figure 2:
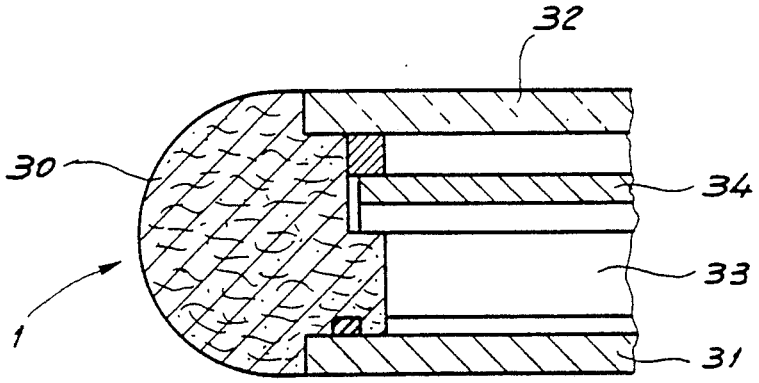
FIG. 2 shows a partial cross-section of the watch case according to the invention and according to a second embodiment, such case being formed of a caseband-bezel made from leather.

FIG. 2 shows a second embodiment of the watch case according to the invention where the leather part of said case comprises a caseband-bezel 30. A back cover 31 and a crystal 32 are assembled in a sealed manner to such caseband-bezel. A movement 33 with its dial 34 is fixed to the interior of the case by well-known means (not shown). The caseband-bezel 30 is manufactured according to one of the two methods mentioned hereinabove.

Figure 3:
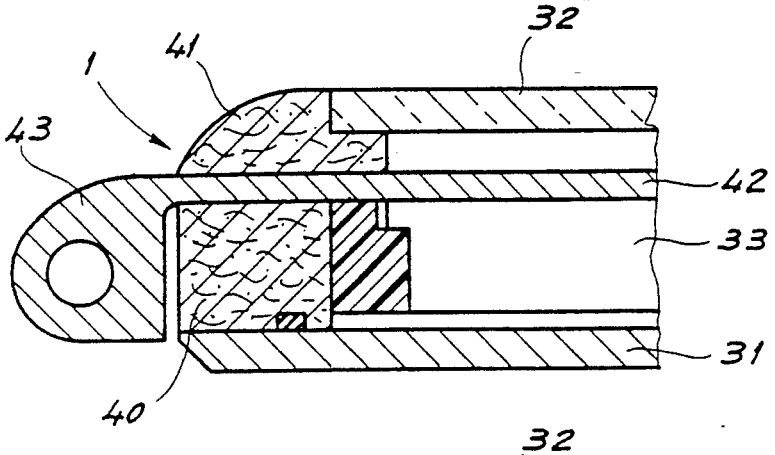
FIG. 3 shows a partial cross-section of the watch case according to the invention and according to a third embodiment, such case being formed of a caseband and bezel made of leather and between which is sandwiched a dial.

FIG. 3 shows a third embodiment of the case according to the invention. Here the caseband 40 and the bezel 41 are manufactured of leather and are shown in two parts separated by a dial 42 sandwiched between said caseband and bezel. One may employ one of the two manufacturing methods mentioned hereinabove to manufacture separately the bezel and the caseband which are thereafter assembled by gluing for instance. The dial may be formed preferably from metal.

In this form the bezel 41 could be of natural leather and the case band 40 of reconstituted leather, this in order to give the case a special aspect and also to render it less expensive.

FIG. 3 further shows that the dial 42 bears means for fastening a bracelet in the form of lugs 43, such lugs being integrally fashioned with the dial. The dial 42 could in this embodiment be totally retained between bezel and caseband without leaving edges visible at the exterior of the periphery of the watch except those edges which bear lugs 43. For aesthetic reasons however the dial 42 could be flush over the entire outer periphery of the caseband 40. In this case, the section thus rendered visible could be coated with a decorative layer as for instance gold.

Figure 4:
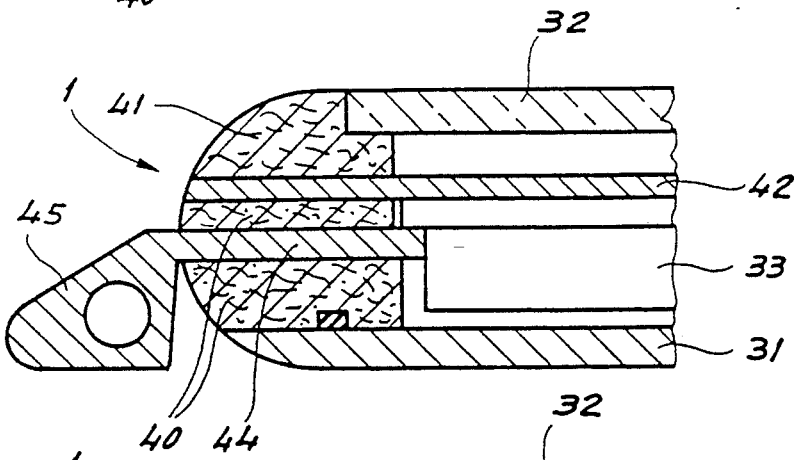
FIG. 4 shows a variant of the embodiment of FIG. 3.

FIG. 4 is a variant of the embodiment shown in FIG. 3. Here the bezel 41 and the caseband 40 are always in two pieces of leather separated by the dial 42. The fastening means 45 for the bracelet are borne by an insert 44 housed in caseband 40. It is seen that the insert is likewise employed in order to support the movement 33.

Figure 5:
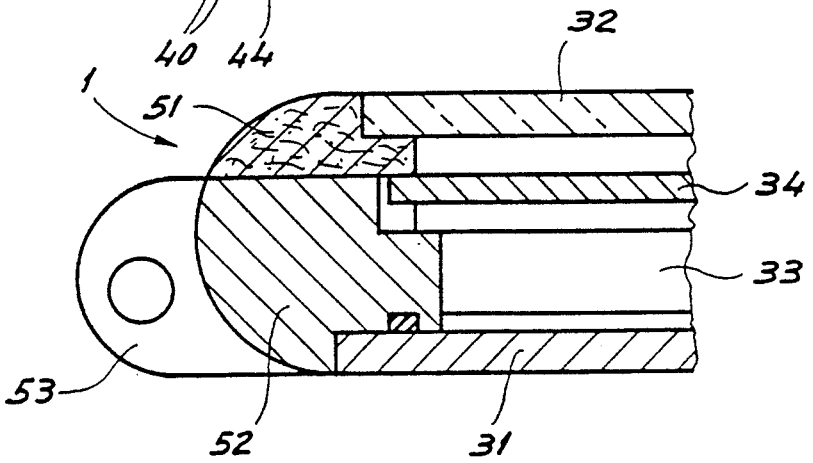
FIG. 5 shows a partial cross-section of the watch case according to the invention and according to a fourth embodiment, such watch case having a bezel made of leather.

FIG. 5 shows a fourth embodiment of the invention. The case here comprises only a single piece of leather: the bezel 51 manufactured according to one of the methods described hereinabove. The bezel is glued onto a caseband 52 formed of a material other than leather, steel for instance. The caseband bears means 53 for fastening a bracelet.

All embodiments of the invention which have just been set forth represent as many possible realizations employing leather as a material composing the basic portions of a watch case. One could readily imagine further combinations and this invention is thus not limited to those forms set out in detail herein.

What we claim is:

1. A watch case having a caseband, a bezel, a back cover and a glass fixed to said bezel, said watch case enclosing a movement onto which a dial is superposed, characterized in that at least one element of the group of elements consisting of said caseband bezel and dial is formed of solid leather and said bezel is formed of leather.

2. A watch case as claimed in claim 1 wherein said leather exhibits a porous structure sealed by an organic impregnating material having a hardness greater than that of the leather.

3. A watch case as claimed in claim 1 wherein said one element is formed by a single thickness of leather.

4. A watch case as claimed in claim 1 wherein said one element is formed by at least two thicknesses of leather glued to one another.

5. A watch case as claimed in claim 1 wherein said caseband and said bezel are formed of leather.

6. A watch case as claimed in claim 1 wherein said leather is natural leather.

7. A watch case as claimed in claim 1 wherein said leather is reconstituted leather.

8. A watch case as claimed in claim 1 wherein said caseband and said bezel comprise an integral structure formed from solid leather.

9. A watch as claimed in claim 1 wherein one element of said group of elements is formed of natural leather and another element of said group of elements is formed of reconstituted leather.

10. A watch case as claimed in claim 1 wherein said caseband, bezel and dial are integrally formed of leather.

11. A watch case as claimed in claim 1 wherein said caseband and said bezel are formed of leather and said dial is interposed between said caseband and said bezel.

12. A watch case as claimed in claim 11 wherein said dial is a metal dial extending beyond the watch case and having means for fastening a bracelet thereto.

13. A watch case as claimed in claim 11 wherein said dial is flush with an outer periphery of said caseband and exhibits a visible section coated with a decorative layer.

14. A watch case as claimed in claim 11 wherein said caseband bears a metallic insert which serves as a support for said movement and as a fastening means for a bracelet.

* * * * *